US006334401B1

(12) United States Patent
Sridhar

(10) Patent No.: US 6,334,401 B1
(45) Date of Patent: Jan. 1, 2002

(54) FLOATING STRUCTURE FOR THE TRANSFER OF CARGO

(75) Inventor: Sidney Sridhar, Richmond (CA)

(73) Assignee: Seabulk Systems Inc., Richmond (CA)

( * ) Notice: Subject to any disclaimer, the term of this patent is extended or adjusted under 35 U.S.C. 154(b) by 0 days.

(21) Appl. No.: 09/644,159

(22) Filed: Aug. 22, 2000

(51) Int. Cl.[7] ..... B65D 88/78

(52) U.S. Cl. ..... 114/256; 114/73; 414/138.1; 414/138.5

(58) Field of Search ..... 114/44, 45, 125, 114/73, 258, 256; 414/138.1, 138.5, 138.4, 138.6, 142.1, 142.2, 142.5

(56) References Cited

U.S. PATENT DOCUMENTS 4,465,012 A * 8/1984 Bos ..... 114/266
4,762,456 A * 8/1988 Nelson ..... 414/138.5
4,795,298 A * 1/1989 Nelson ..... 114/44
5,215,024 A * 6/1993 McAllister ..... 114/45
5,913,278 A * 6/1999 Mitchell ..... 114/45
6,010,295 A * 1/2000 Sridhar ..... 414/138.5

FOREIGN PATENT DOCUMENTS

GB 2 298 629 A 9/1996

* cited by examiner

*Primary Examiner*—Stephen Avila
(74) *Attorney, Agent, or Firm*—Elbie R. de Kock

(57) ABSTRACT

A sea faring transshipper for transferring cargo from a bulk carrier to a secondary vessel comprises a pair of units provided with mutually engaging connectors for connecting the units together along a direction of travel of the transshipper. Each unit comprises a pair of spaced buoyant vessels, a platform supported by the buoyant vessels in a raised position above the buoyant vessels through wall members extending upwardly from the buoyant vessels and a hull contacting member extending between the buoyant vessels for contacting the underside of a bulk carrier being unloaded. The platform, wall members and hull contacting member define an opening for surrounding the bulk carrier being unloaded. The transshipper also includes a ballasting system for maintaining the hull contacting member in contact with the hull of the bulk carrier being unloaded. A method of unloading cargo from a bulk carrier using the transshipper is also provided.

10 Claims, 8 Drawing Sheets

FLOATING STRUCTURE FOR THE TRANSFER OF CARGO

FIELD OF THE INVENTION

This invention relates to a floating vessel or transhipper for the transfer of cargo from a ship, such as a cape-size bulk carrier to a barge or a shoreside conveyor at a dock, as well as for other cargo transfer operations. The invention also relates to a method of cargo transfer.

BACKGROUND OF THE INVENTION

It is a problem with harbours without deep water docking facilities that large cargo ships cannot be accommodated. One solution to the problem is to anchor the vessel in open water and to unload the cargo onto a lighter vessel which can be accommodated in the harbour.

Since the deep water locations are sometimes exposed to the open sea and subject to wave action, the stability of the transshiper is a concern. In addition, the efficient unloading of the ship is important for carrying out the cargo transfer operation economically.

SUMMARY OF THE INVENTION

According to the invention there is provided a sea faring transhipper for transferring cargo from a bulk carrier to a secondary vessel, comprising a pair of units provided with mutually engaging connectors for connecting the units together along a direction of travel of the transhipper, wherein each unit comprises a pair of spaced buoyant vessels; a platform supported by the buoyant vessels in a raised position above the buoyant vessels through wall members extending upwardly from the buoyant vessels; a hull contacting member extending between the buoyant vessels for contacting the underside of a bulk carrier being unloaded, the platform, wall members and hull contacting member defining an opening for surrounding the bulk carrier being unloaded; and a ballasting system for maintaining the hull contacting member in contact with the hull of the bulk carrier being unloaded.

Also according to the invention there is provided a method of unloading cargo from a bulk carrier using a transhipper comprising a pair of units provided with mutually engaging connectors for connecting the units together along a direction of travel of the transhipper, wherein each unit comprises a pair of spaced buoyant vessels; a platform supported by the buoyant vessels in a raised position above the buoyant vessels through wall members extending upwardly from the buoyant vessels; and a hull contacting member extending between the buoyant vessels for contacting the underside of a bulk carrier being unloaded, the platform, wall members and hull contacting member defining an opening for surrounding the bulk carrier being unloaded, comprising the steps of positioning the transhipper with the units connected together with said opening surrounding the bulk carrier; disconnecting the units from one another; moving the units away from each other along the length of the bulk carrier to selected unloading positions; and ballasting the units to engage the underside of the bulk carrier, whereby the units are stabilized through said engagement with the bulk carrier.

Further objects and advantages of the invention will become apparent from the description of preferred embodiments of the invention below.

BRIEF DESCRIPTION OF THE DRAWINGS

The invention will now be described, by way of example, with reference to the accompanying drawings, in which.

DETAILED DESCRIPTION OF PREFERRED EMBODIMENT

Figure 1:
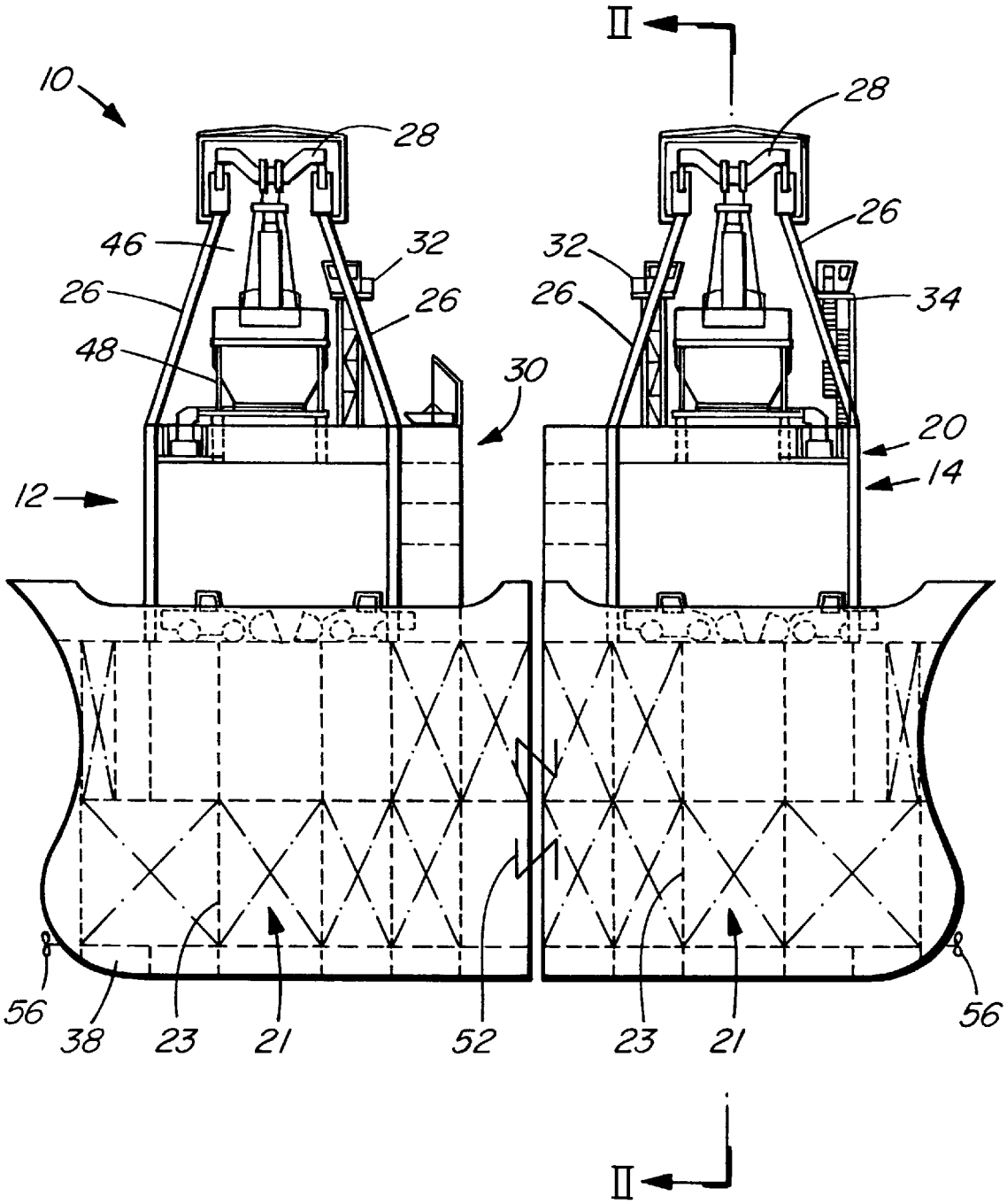
FIG. 1 is a side view of a cargo unloader vessel according to the invention.
Figure 2:
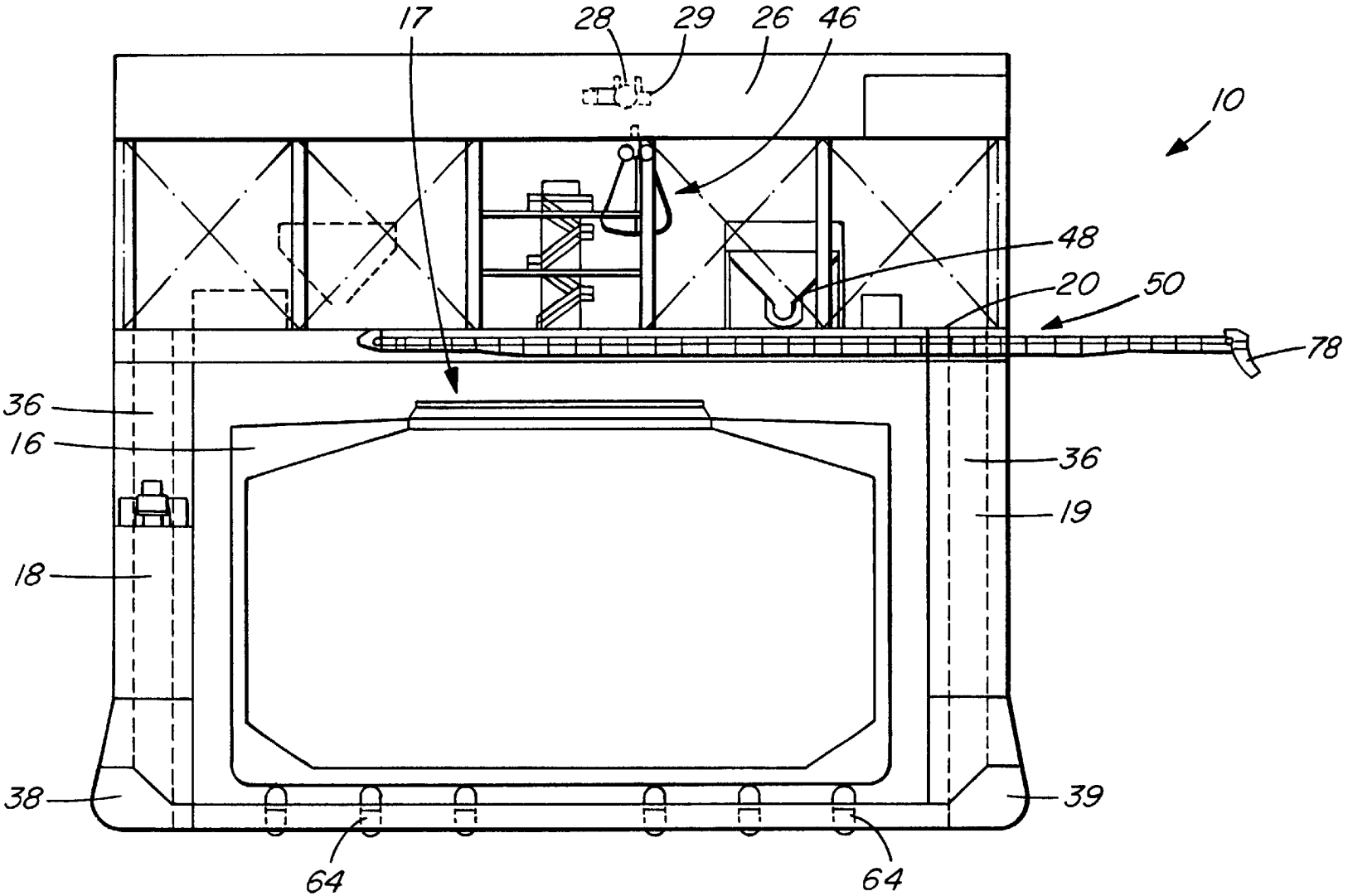
FIG. 2 is a transverse section of the cargo unloader vessel of FIG. 1.
Figure 3:
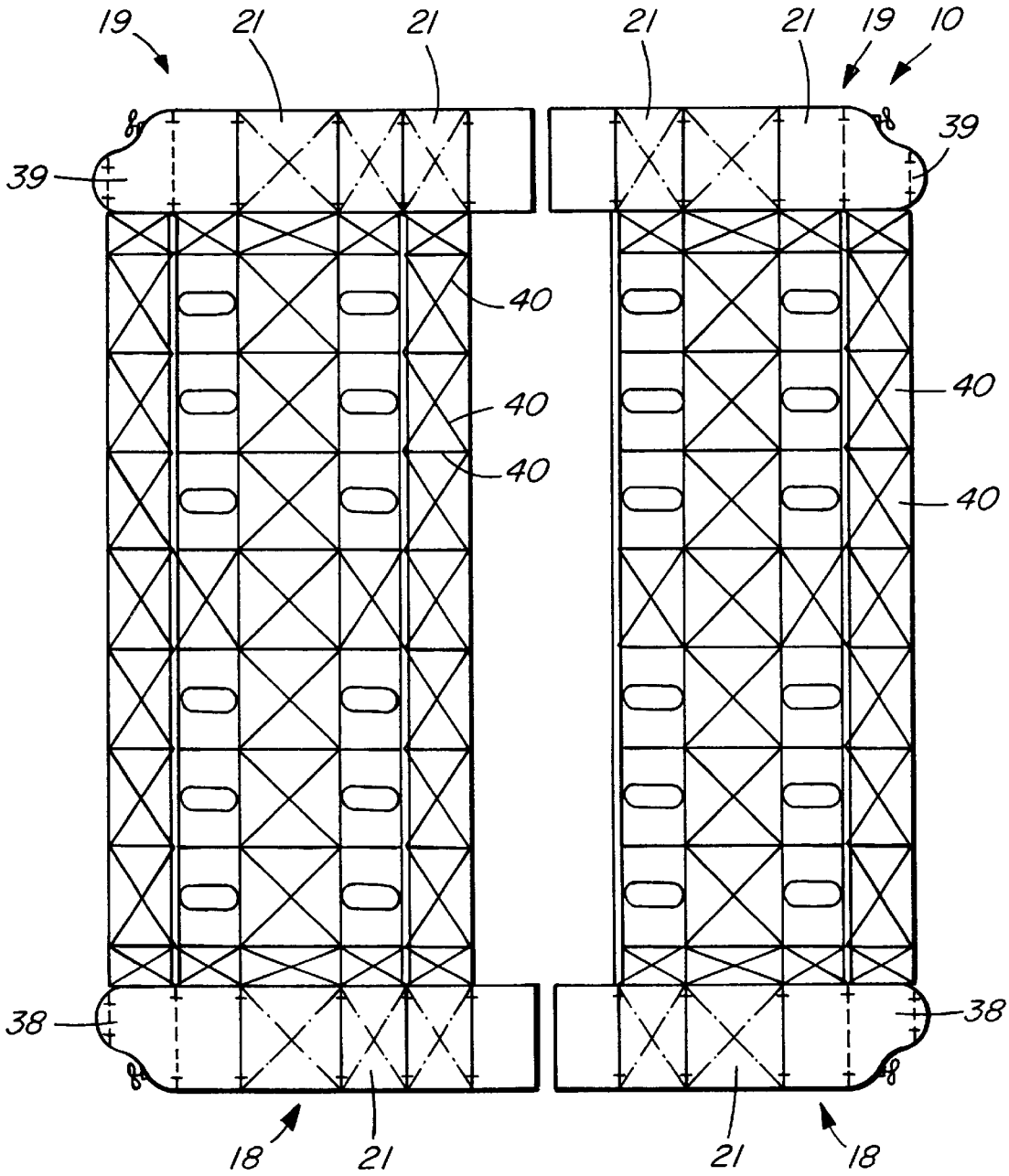
FIG. 3 is top view of pontoons and girder mesh of the vessel of FIG. 1.

With reference to FIGS. 1 to 3, reference numeral 10 generally indicates a cargo unloader vessel, which comprises two units 12 and 14 that in use span over two hold spaces 17 of a cape-size bulk carrier 16. The units 12, 14 can be interlocked to act as one vessel and can be separated during an unloading operation. Each unit 12, 14 comprises two buoyant vessels or pontoons 38, 39 connected by solid girders 40 which form a steel grillage extending between the pontoons, as shown in FIG. 3.

In FIG. 2, a pair of wall-sided caissons 18, 19 extend upwardly from each of the pontoons 38, 39, respectively, and support a platform deck 20, spanning the space between the caissons 18, 19. The caissons 18, 19 are hollow shells and act as the main buoyancy units. As shown in FIG. 3, ballast tanks 21 are provided in the caissons 18, 19 to maintain the required immersion level before, during and after a cargo handling operation, with suitable valves for the inflow and outflow of water. They also serve to balance the moving loads within the cargo bay area or hold space 17 of the carrier 16. Water tight bulkheads 23 are provided between the ballast tanks 21, both vertically and horizontally between the caissons 18, 19. The caissons 18, 19 may also serve as storage space for fuel oil tanks and utility tanks, the depletion or replenishment of which tanks is compensated by appropriate ballast control. The caissons 18, 19 also accommodate machinery and pump rooms. Access ducts for personnel are present to allow passage to various areas. Conduits for service lines are also provided. The caissons 18, 19 have bottom and bilge strakes which are longitudinally stiffened, with intercostal transverse members. The caissons 18, 19 have top plates which are also stiffened longitudinally.

Figure 4:
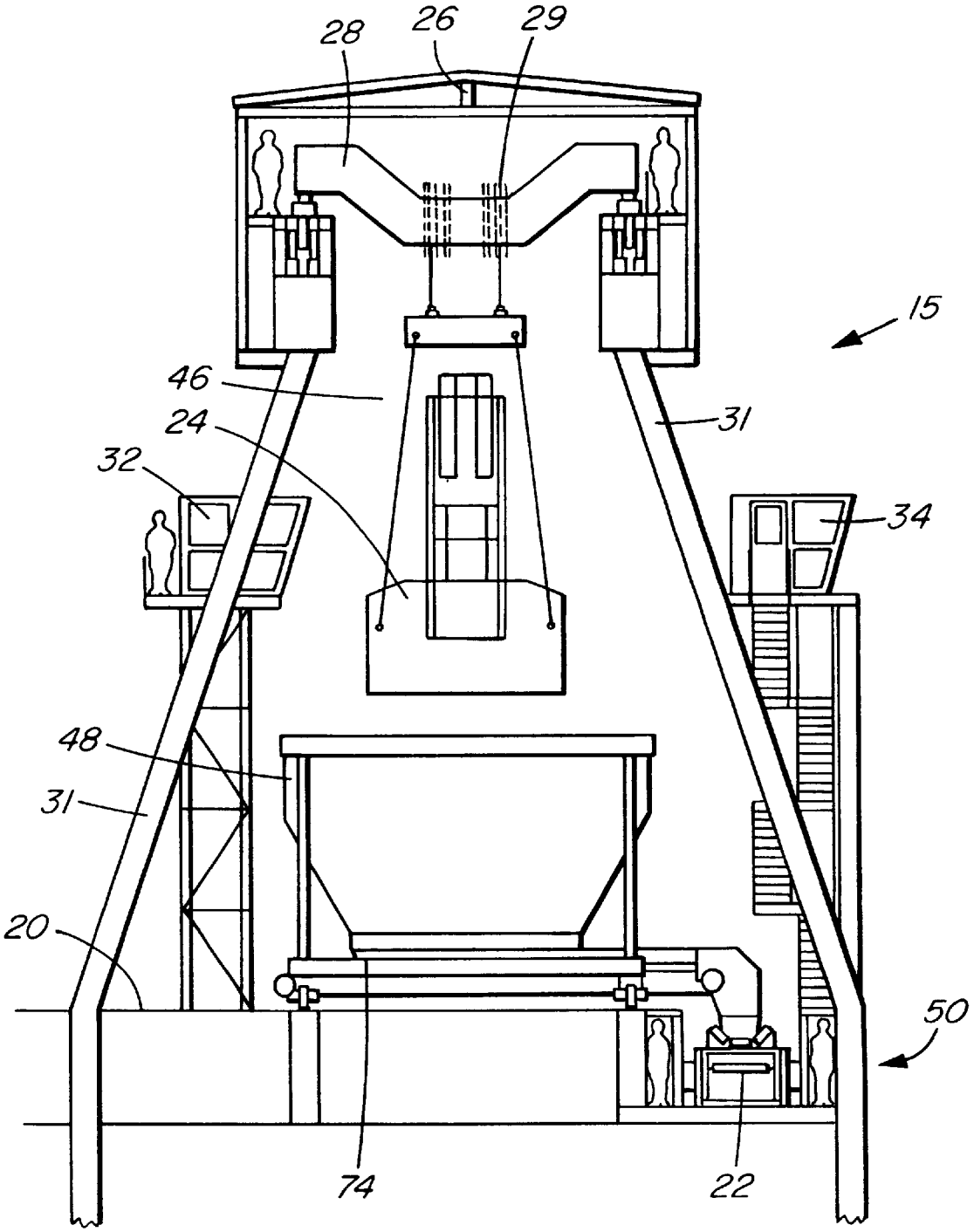
FIG. 4 showns a side view of a crane trolley and winch system, with a grab and conveyor system of the vessel of FIG. 1.
Figure 5:
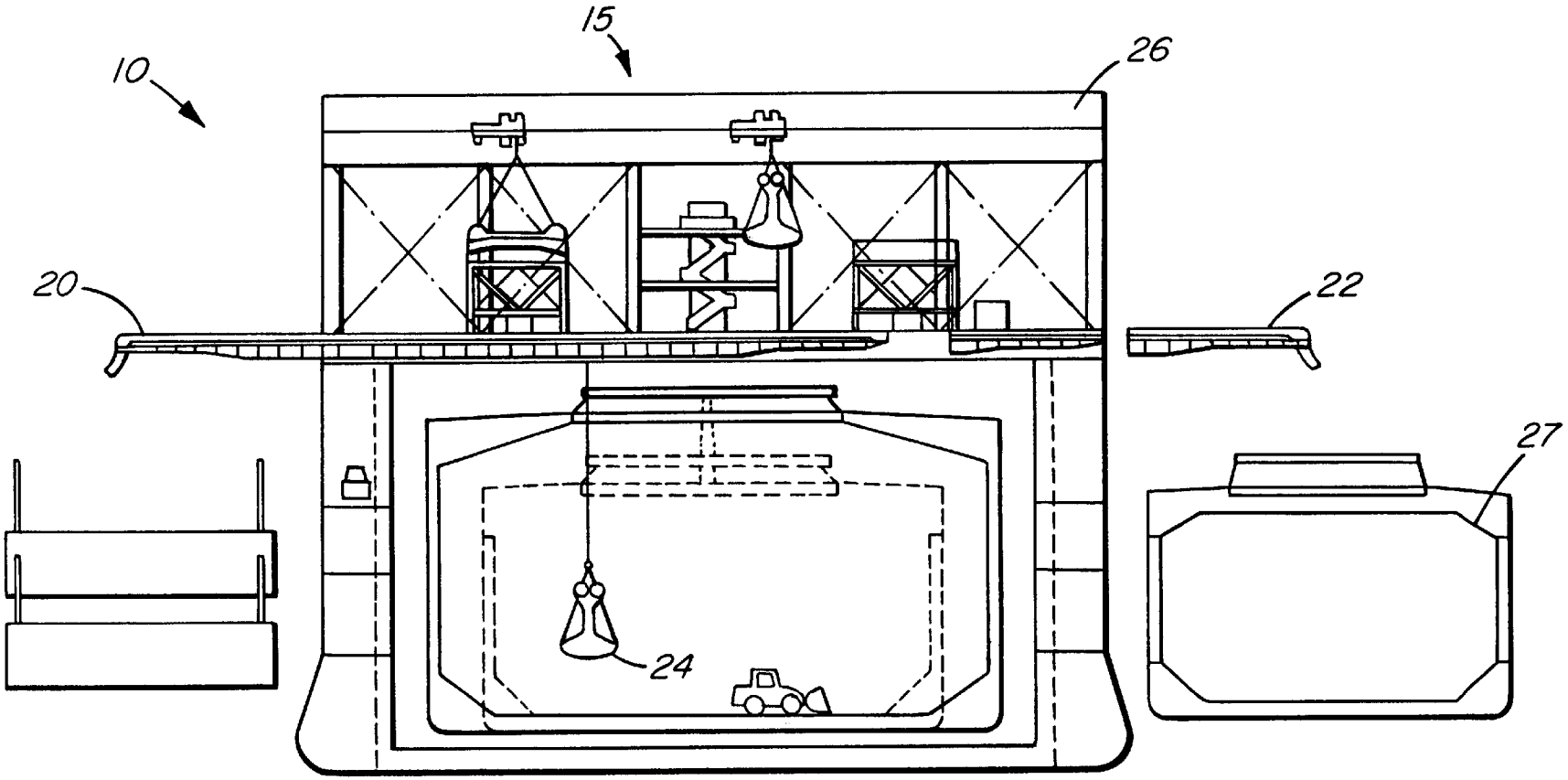
FIG. 5 is another transverse section of the vessel of FIG. 1 illustrating an unloading operation.
Figure 6:
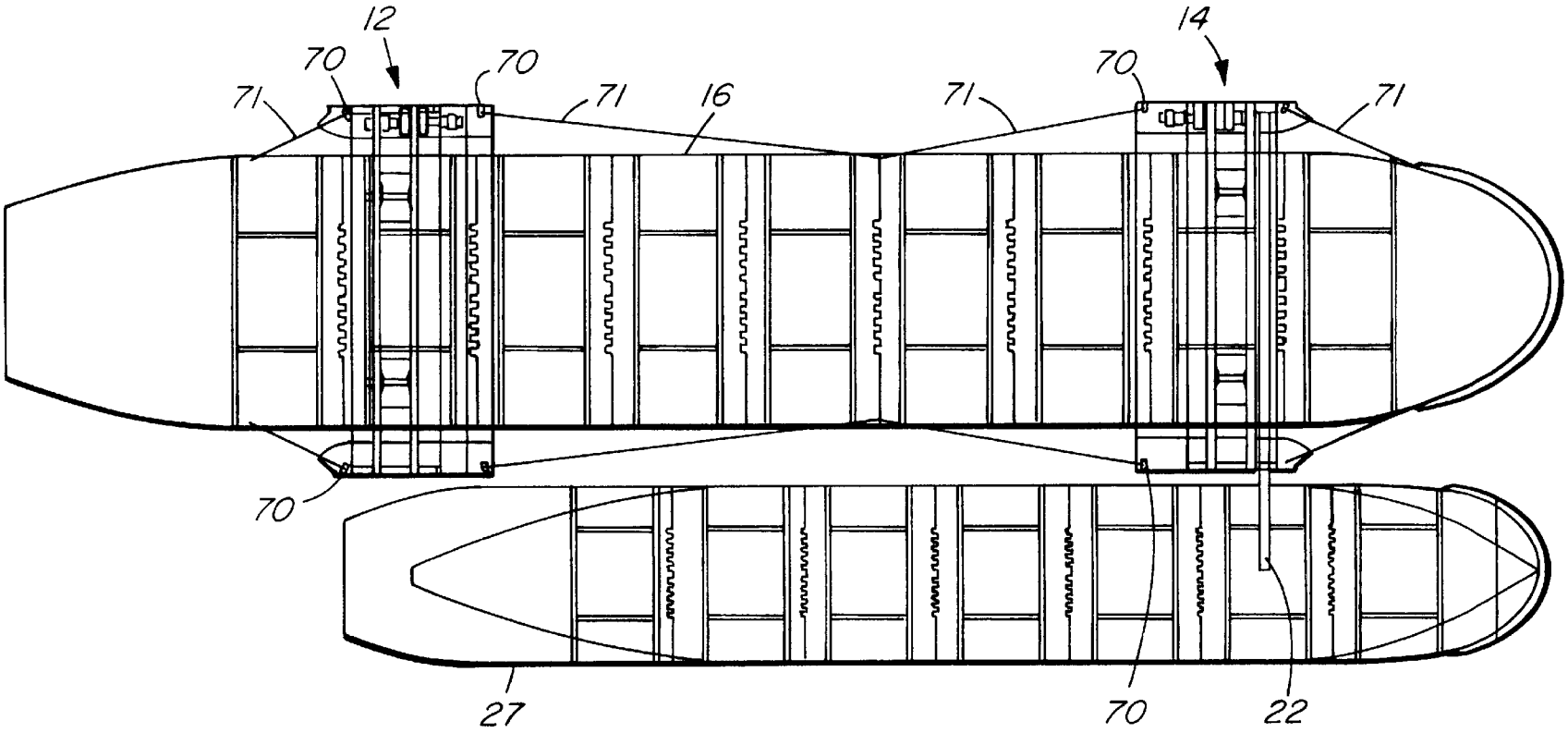
FIG. 6 is a plan view illustrating an unloading operation.

The cargo unloader vessel 10 further comprises material handling apparatus 15 as shown in FIGS. 4 and 5, for transferring material or cargo from the bulk carrier 16 to the platform deck 20, which material is further transferred by a reversible shuttle load-out conveyor 22 to a transfer vessel or barge 27 alongside the bulk carrier 16 (FIG. 6). Each unit 12, 14 has a grab crane 46 including a grab 24 for the handling of cargo. The grab 24 is supported on a fixed steel girder 26 located above the platform deck 20. A trolley 28 equipped with a hoisting/closing winch 29 enables the grab 24 to travel horizontally along the girder 26.

Figure 7:
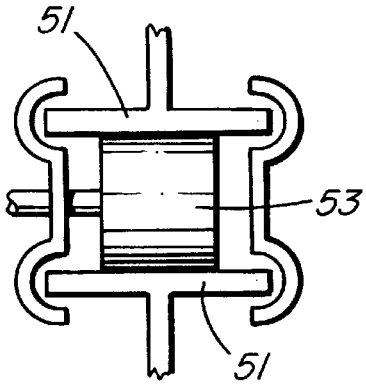
FIG. 7 is a fragmentary side view showing the locking of a wheel of the trolley of FIG. 4 between a pair of tracks.

A pair of spaced tracks 51 is provided on opposite sides of the trolley 28. The trolley 28 has wheels 53 which run along the tracks 51 and are locked between the tracks 51, as shown in FIG. 7.

An accommodation module 30 is located on the platform deck 20 for housing crew (FIG. 1). A cargo control room 32 and a navigational control room 34 extend vertically from the platform deck 20.

The platform deck 20 is supported on elevated portals 36 above the caissons 18, 19. The platform deck 20 is provided with a large deck opening for the material handling apparatus 15 and cargo movements. It is strengthened transversely and longitudinally by web structures and girders at appropriate intervals. The platform deck 20 forms a side-to-side continuous deck on each unit 12, 14. In use, the platform deck 20 spans the hold of the carrier 16 and provides the space for the grab crane 46, a hopper 48, and a conveyor system 50 (FIG. 4).

The hopper 48 is movable transversely of the carrier 16, in the same direction as the trolley 28, and is winch-operated for effecting this movement.

Figure 8:
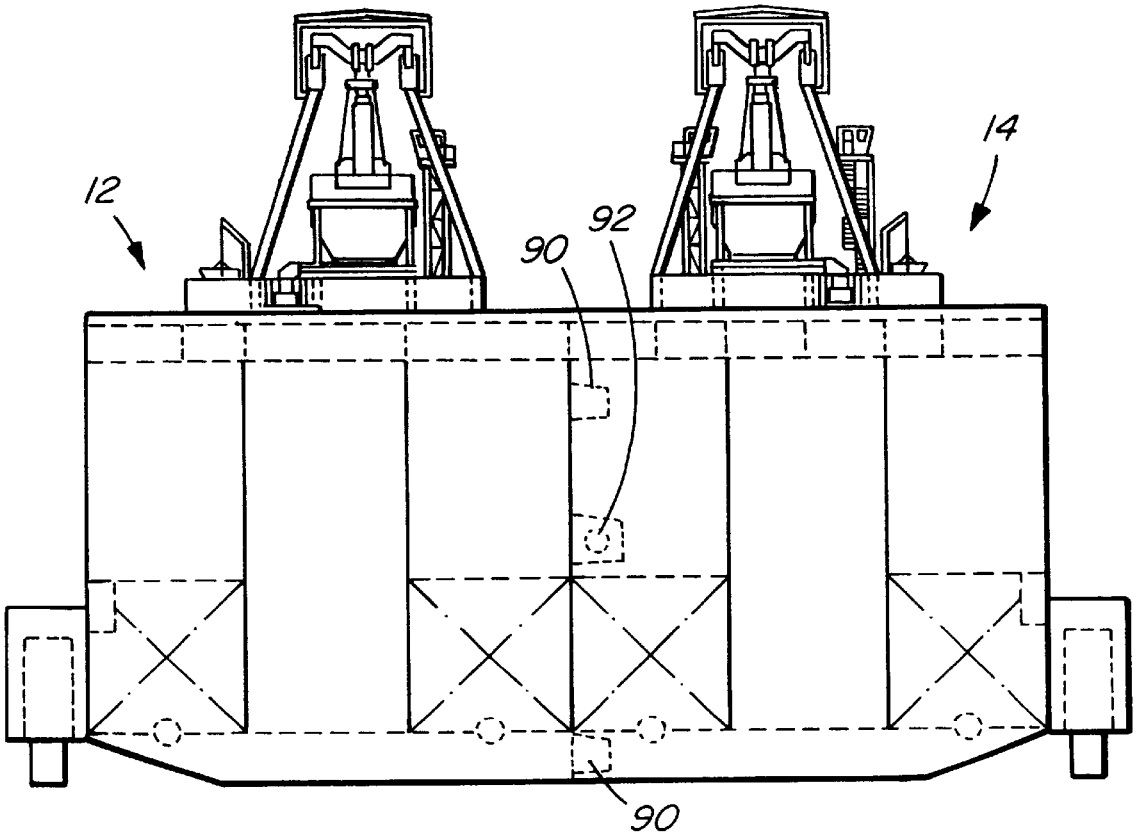
FIG. 8 is a schematical side view of a cargo unloader vessel showing details of a coupler system connecting two parts of the unloader vessel together.
Figure 9:
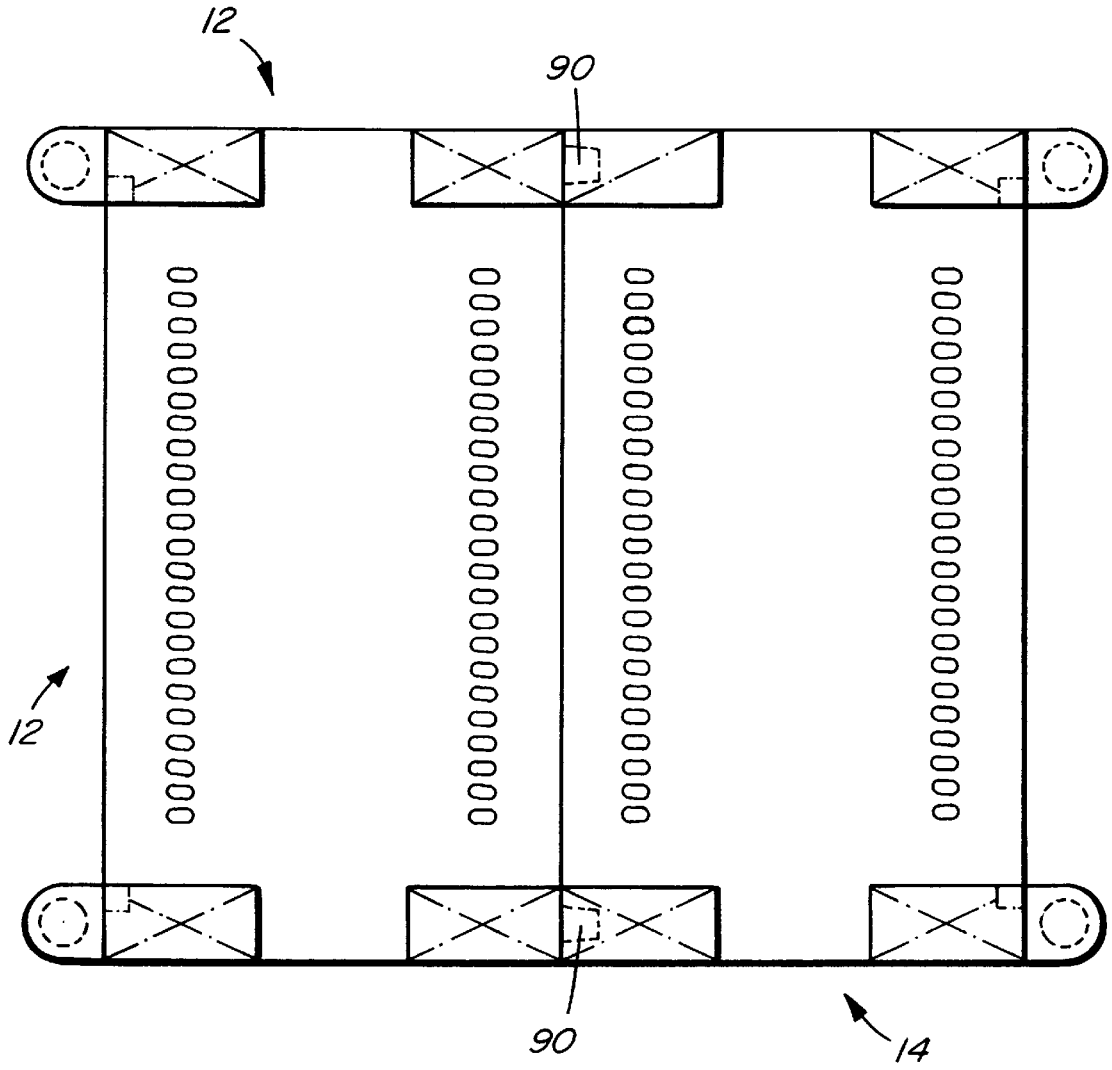
FIG. 9 is a plan view of the unloader vessel of FIG. 8.

As shown in FIG. 1, the units 12 and 14 are integrated into a single vessel by a suitable coupler system 52. Details of a suitable coupler system are shown in FIGS. 8 and 9. The unit 12 is provided with tapered pins 90 which are received in corresponding recesses provided on the unit 14, thereby locating the units 12, 14 in position together. The units 12, 14 are then locked together by means of a locking pin 92 extending through corresponding pin holes in the units 12, 14. The connection is rigid along the horizontal, vertical and longitudinal axes. The units 12, 14 remain interlocked during engagement and disengagement phases with the bulk carrier 16. Once the engagement phase is completed, the two units 12, 14 separate and move to their respective cargo hold positions along the length of the carrier 16 using self-tensioning winches.

Each unit 12, 14 is equipped with a pair of rudder propellers 56, such as those available under the name Schottel®, for sailing as well as for precision maneuvering around ships, before, during, and after cargo handling operations. Each rudder propeller 56, is a propulsion and steering unit comprising a propeller encased in a housing whereby the housing is able rotate horizontally to modify the direction of the unit 12, 14 or the entire vessel 10. In FIG. 3, these propellers 56 are fitted at the starboard-rear of the starboard caisson 18 and the starboard-forward of the port caisson 19 of unit 12 and the port-forward of the port caisson and the port-aft of the starboard caisson of unit 14. The cargo unloader vessel 10 can propel independently of the bulk carrier 16 and each unit 12, 14 can propel and function independently of the other when spanning over the bulk carrier hold 17 using laser guided positioning systems.

Trim tanks are used to bring the positions of the interlocking mechanisms of the coupler system 52 on each of the units 12, 14 in line with one another. Sensors are used along with the rudder propellers 56, ballast and trim control to achieve the interlocking sequence.

Prime movers for the rudder propellers 56 are arranged within the caissons 18, 19 at a sufficient height above the pontoons 38, 39.

Fender systems are provided either on a permanent basis, or as a temporary attachment to provide for differences in bulk carrier 16 dimensions. Bottom wheel fenders 64 are located on the solid girders 40 forming the grillage between the pontoons 38, 39 and move along the lower surface of the bulk carrier 16 hull when the cargo unloader vessel 10 is engaging the bulk carrier 16. The grillage therefore acts as a hull contacting member which presses against the hull of the carrier 16. In this way each unit 12, 14 is anchored to the carrier importing stability to the units 12, 14 and counteracting relative movement between the carrier 16 and the units 12, 14.

Inboard side fenders are located on the inside walls of the caissons 18, 19 and are capable of absorbing the normal pressures exerted by the ship hull under normal operating conditions. Undue motions are absorbed by this fender system. An external floating fender system is located on the outside walls of the caissons 18, 19. These outboard side fenders are provided to facilitate secondary host ships or barges 27 coming into sufficient proximity of the platform deck 20 during unloading operations. Contact loads between the secondary vessel 27 and the ship are absorbed by the external fender system.

Self-tensioning winches 70 having cables 71 are used to keep the platform deck 20 in the required horizontal position with respect to the bulk carrier 16. These winches are on an elevated partial deck above the caisson 18, 19 top level. The positioning of the platform deck 20 is achieved by constant tension of the winches on the platform deck 20. The winches are driven in pairs and controlled by command inputs from the cargo control room 32 located on the platform deck 20. The drives are load dependent. In this condition, the velocity of the drive is proportional to the load applied. The constant tension operating condition allows the drives reverse direction when the maximum load setting is reached. This allows the unit 12,14 to rise and fall due to wave action but with a dampened response. The line tension and velocity are adjustable within the performance range to the drive and respond directly to input commands from the control room 32.

As shown in FIGS. 4 and 5, the crane trolley 28 and winch system 29 are supported above the platform deck 20 by two diagonal supports 31 extending from the platform deck 20. The grab 24 descends vertically from the crane trolley 28 and is power-operated with the winch 29. The grab 24 descends through control flow gates 74 on the platform deck 20, down to the cargo hold 17 of the bulk carrier 16. Material or cargo is lifted by the grab 24. Material from the grab 24 is discharged into the winch operated travelling hopper 48 located at the top of the floating caisson 18, 19 structive, and gravity feeds to the reversible shuttle load-out conveyor 22 which delivers material into the secondary transfer vessel or barge 27. The conveyor 22 is reversible. It is also retractable when not in use. A trim chute 78 is located at the end of the conveyor 22 for the release of cargo or material into the transfer vessel 27. The grab 24, travelling hopper 48 and reversible shuttle load-out conveyor 22 are all powered by the electrical generators located on the platform deck 20.

Deck equipment for anchoring, mooring and maneuvering are arranged on partial elevated decks aft of the aft unit 12 and the forward end of the forward unit 14 at the caisson 18, 19 coaming level. Deck equipment includes facilities for anchor handling and storing, rope handling systems for mooring and maneuvering winches, and other utility arrangements. Additional deck equipment is arranged on another elevated deck level near the interface of the two units 12, 14.

In use, the cargo unloader vessel 10 approaches a bulk carrier 16 under its own power, propelled by the rudder propellers 56. It is maneuvered by means of the rudder propellers 56 so that the U-shaped hull configuration of the cargo unloader vessel 10 slips under the bow of the bulk carrier 16 and envelopes the bulk carrier hull.

The cargo unloader vessel 10 makes contact with the bulk carrier hull with wheel fenders 64. The wheel fenders 64 roll along the hull of the bulk carrier 16 as the cargo unloader vessel is engaging it. The inboard side fenders absorb normal pressures exerted by the bulk carrier hull.

Once the cargo unloader vessel 10 has enveloped the bulk carrier hull, the units 12 and 14 are separated by disengaging the locking system 52 and using their rudder propellers 56 to move independently and precision maneuvering along the bulk carrier 16.

Each unit 12, 14 uses the ballasting tanks 21 located in the caissons 18,19 to ballast or deballast, using a suitable valve for the flow of water in and out of the ballast tanks 21 in order to adjust the draft and trim of the units 12,14.

The unloading operation is performed by the winch controlled grab 24 descending from the crane trolley 28. As the winch 29 is activated, the grab 24 is lowered through the control flow gates 74 on the platform deck 20 into the bulk carrier hold 17, where the grab 24 can transport front end unloaders 19 to and from the bulk carrier hold 17. The grab 24 can also lift material or cargo from the bulk carrier hold 17 up to the hopper 48. The cargo or material is gravity fed to the reversible shuttle load-out conveyor 22 which brings the material or cargo to the trim chute 78 for release into the secondary transfer vessel 27. This cycle is repeated as the grab 24 descends back down into the bulk carrier hold 17 to lift up more material or cargo.

Once the bulk carrier hold 17 has been emptied of its contents by the above described unloading operation, the reversible shuttle load-out conveyor 22 is retracted into the unit 12, 14 and the self-tensioning winches 71 are released. With the rudder propellers 56, the two units 12, 14 will adjust adjacent trim with the ballasting tanks 21 and join and lock together with the locking system 52. The cargo unloading vessel 10 will adjust the ballast to its transit mode and debark from the bulk carrier 16 under its own propulsion power. The secondary transport vessel 27 with the reclaimed material or cargo is now able to transport the shipment to its destination port.

Although certain preferred embodiments of the present invention have been shown and described in detail, it should be understood that various changes and modifications may be made therein without departing from the scope of the appended claims.

What is claimed is:

1. A sea faring transhipper for transferring cargo from a bulk carrier to a secondary vessel, comprising a pair of units provided with mutually engaging connectors for connecting the units together along a direction of travel of the transhipper, wherein each unit comprises:

a pair of spaced buoyant vessels;

a platform supported by the buoyant vessels in a raised position above the buoyant vessels through wall members extending upwardly from the buoyant vessels;

a hull contacting member extending between the buoyant vessels for contacting the underside of a bulk carrier being unloaded, the platform, wall members and hull contacting member defining an opening for surrounding the bulk carrier being unloaded; and a ballasting system for maintaining the hull contacting member in contact with the hull of the bulk carrier being unloaded.

2. The transhipper of claim 1, wherein the hull contacting member is provided with wheel fenders for contacting the hull of the bulk carrier.

3. The transhipper of claim 1, wherein at least one of the units is provided with a propulsion unit for propulsion and steering of the transhipper as a unitary structure when the units are connected together.

4. The transhipper of claim 3, wherein the propulsion unit comprises a rudder propeller located on each one of said buoyant members.

5. The transhipper of claim 1, wherein each of the units is provided with a propulsion unit for independent propulsion and steering of the units when the units are disconnected from each other.

6. The transhipper of claim 5, wherein the propulsion unit comprises a rudder propeller located on each one of said buoyant members.

7. The transhipper of claim 1, wherein of at least one of the units is provided with a material handling system for conveying cargo or cargo handling equipment to or from a hold of the bulk carrier.

8. The transhipper of claim 7, wherein the material handling system comprises a trolley which is movable along an overhead rail extending transversely of the bulk carrier; and a grab crane supported by the trolley for loading into the hold of the bulk carrier.

9. The transhipper of claim 8, wherein the material handling system further comprises a movable hopper for receiving material from the grab crane and a conveyor for receiving material from the hopper and for conveying the material to an unloading location.

10. A method of unloading cargo from a bulk carrier using a transhipper comprising a pair of units provided with mutually engaging connectors for connecting the units together along a direction of travel of the transhipper, wherein each unit comprises a pair of spaced buoyant vessels; a platform supported by the buoyant vessels in a raised position above the buoyant vessels through wall members extending upwardly from the buoyant vessels; and a hull contacting member extending between the buoyant vessels for contacting the underside of a bulk carrier being unloaded, the platform, wall members and hull contacting member defining an opening for surrounding the bulk carrier being unloaded, comprising the steps of:

positioning the transhipper with the units connected together with said opening surrounding the bulk carrier;

disconnecting the units from one another;

moving the units away from each other along the length of the bulk carrier to selected unloading positions; and ballasting the units to engage the underside of the bulk carrier, whereby the units are stabilized through said engagement with the bulk carrier.

* * * * *